United States Patent [19]

Berger

[11] Patent Number: 4,897,765

[45] Date of Patent: Jan. 30, 1990

[54] SIGNAL GENERATING AND TRANSMITTING APPARATUS WITH MOBILE SHROUD FOR ELECTRIC TERMINALS

[75] Inventor: Fritz Berger, Oberbuchsiten, Switzerland

[73] Assignee: Elektro-Apparatebau Olten AG, Olten, Switzerland

[21] Appl. No.: 295,974

[22] Filed: Jan. 11, 1989

[30] Foreign Application Priority Data

Jan. 14, 1988 [CH] Switzerland ..... 110/88

[51] Int. Cl.[4] ..... H05M 5/00

[52] U.S. Cl. ..... 361/394; 361/392; 361/404; 361/417; 361/419; 439/131

[58] Field of Search ..... 361/392, 394, 406, 404, 361/405, 417, 419–420; 439/131, 141, 142, 149, 398, 892; 200/314, 67 A; 250/227, 229

[56] References Cited

U.S. PATENT DOCUMENTS

| | | | |
|---|---|---|---|
| 3,754,205 | 8/1973 | Lenkey | 439/141 |
| 3,839,697 | 10/1974 | Obert | 439/141 |
| 4,340,267 | 7/1982 | Nukaga | 439/141 |
| 4,398,075 | 8/1983 | Vogel | 200/314 |
| 4,766,306 | 8/1988 | Bichsel et al. | 250/227 |

FOREIGN PATENT DOCUMENTS 0587373 11/1933 Fed. Rep. of Germany .

*Primary Examiner*—Gregory D. Thompson
*Attorney, Agent, or Firm*—Peter K. Kontler

[57] ABSTRACT

The housing of a signal generating and transmitting apparatus carries a reciprocable shroud which is movable relative to the housing between a first position in which the electric terminals of the housing are exposed and can be connected to conductors, and a second position in which the terminals are confined in the shroud. Detents are provided on the housing and on the shroud to releasably hold the shroud in the first and second positions as well as to prevent detachment of the shroud from the housing. If the housing carries a casing for one or more radiation sources, the parts which releasably secure the casing to the housing can be disengaged from each other in response to movement of the shroud to the third position in which one or more disengaging members of the shroud separate the securing elements on the casing from complementary securing elements on the housing.

15 Claims, 4 Drawing Sheets

SIGNAL GENERATING AND TRANSMITTING APPARATUS WITH MOBILE SHROUD FOR ELECTRIC TERMINALS

BACKGROUND OF THE INVENTION

The present invention relates to current consuming apparatus in general, especially to electrically operated signal generating and/or transmitting apparatus.

Apparatus of the type to which the present invention pertains are disclosed, for example, in German Pat. No. 587,373. The cylindrical housing of the patented apparatus has an external thread which can mate with the internal thread of a shroud in the form of a cap having windows for conductors serving to connect the terminals of the housing with a source of electrical energy. In order to connect the conductors to the terminals, the cap is detached from the housing, the conductors are caused to pass through the windows of the cap, and the end portions of the conductors are soldered or otherwise secured to the respective terminals. In the next step, the cap is caused to slide along the conductors and is brought into mesh with the housing. A drawback of the patented apparatus is that the cap must be fully separated from the housing preparatory to attachment of conductors to the terminals, i.e., the cap can be lost or misplaced. Moreover, separation of the cap from and attachment of the cap to the housing is a time-consuming procedure.

OBJECTS OF THE INVENTION

An object of the invention is to provide a novel and improved guard or shroud for the electric terminals of current-consuming apparatus, particularly signal generating and/or transmitting apparatus.

Another object of the invention is to provide a guard or shroud which is less likely to be lost or misplaced than the corresponding parts of conventional apparatus.

A further object of the invention is to provide the apparatus with novel and improved means for releasably holding the shroud in selected positions with reference to the terminals and with reference to the housing which supports the terminals.

An additional object of the invention is to provide a novel and improved housing for use in the above outlined apparatus.

Still another object of the invention is to provide novel and improved means for more or less permanently coupling the shroud to the housing.

A further object of the invention is to provide a shroud which, in addition to shielding the terminals of a current-consuming apparatus, can also perform other desirable functions.

An additional object of the invention is to provide a simple and inexpensive shroud which can be properly secured to a housing even though it need not be provided with threads.

SUMMARY OF THE INVENTION

The invention is embodied in a current consuming apparatus, particularly in a signal generating and/or transmitting apparatus. The improved apparatus comprises a housing (e.g., a tube) including a front portion and a rear portion, a plurality of electric terminals carried by the housing and extending beyond the rear portion, and an electrically insulating shroud or guard which is mounted on and is reciprocable relative to the housing (preferably along a substantially straight path) between a first position in which the terminals are exposed and accessible (particularly for connection with or for disconnection from electrical conductor means), and a second position in which the terminals are at least partially but preferably at least substantially or entirely confined in the shroud. The shroud has one or more windows through which the terminals extend from the shroud in the first position of the shroud. The terminals are preferably elongated and parallel to the path of reciprocatory movement of the shroud between its first and second positions.

The apparatus preferably further comprises means for inseparably coupling the shroud to the housing so that the shroud is not likely to be lost or misplaced.

Still further, the apparatus can comprise detent means for releasably holding the shroud in at least one of its positions. Such detent means can comprise complementary first and second detent elements which serve to form-lockingly or force-lockingly hold the shroud in the one position (particularly in the second position). The first element or elements are provided on or in the housing, and the second element or elements are provided on or in the shroud.

In accordance with a presently preferred embodiment, the detent means comprises a first unit having means for releasably holding the shroud in the first position with a first force, and a second unit having means for releasably holding the shroud in the second position with a second force which may but need not equal the first force. For example, the second force can greatly exceed the first force. At least one of the two units can comprise means for form-lockingly or force-lockingly holding the shroud in the respective position. The detent means can include or can be combined with the aforementioned means for inseparably coupling the shroud to the housing.

The apparatus can further comprise a casing and disengageable means for releasably securing the casing to the housing. The shroud of such apparatus is preferably further movable relative to the housing to a third position and is provided with means for disengaging the securing means in the third position so that the housing and the casing can be separated from each other. The casing or the housing can support at least one signal lamp.

The securing means can comprise a first detent element on the casing and a second detent element which is provided on or in the housing and normally engages the first detent element to thereby secure the casing to the housing. The disengaging means of the shroud can include means for separating the first and second detent elements from each other in response to movement of the shroud to its third position. The terminals on the housing preferably extend outwardly beyond the window or windows of the shroud when the latter assumes its third position. Such apparatus can also comprise detent means for releasably holding the shroud in at least one of its first and second positions, and such detent means can be identical with or analogous to the detent means of apparatus which does not employ a casing, i.e., wherein one or more lamps or other suitable signal generating and/or transmitting means are mounted directly in or on the housing.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF PREFERRED EMBODIMENTS

Figure 1:
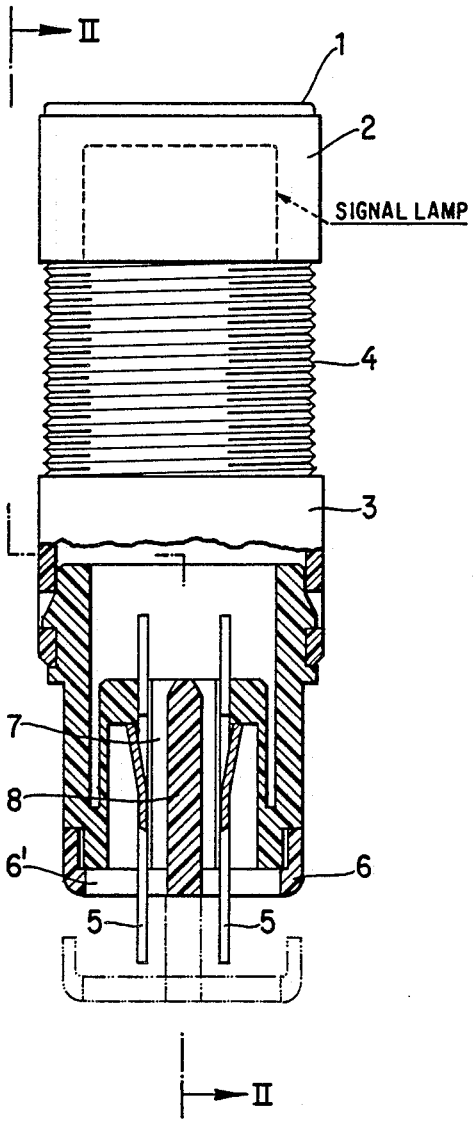
FIG. 1 is a schematic partly elevational and partly longitudinal sectional view of an apparatus which embodies one form of the invention, the view being taken in the direction of arrows from the line I—I of FIG. 2.
Figure 2:
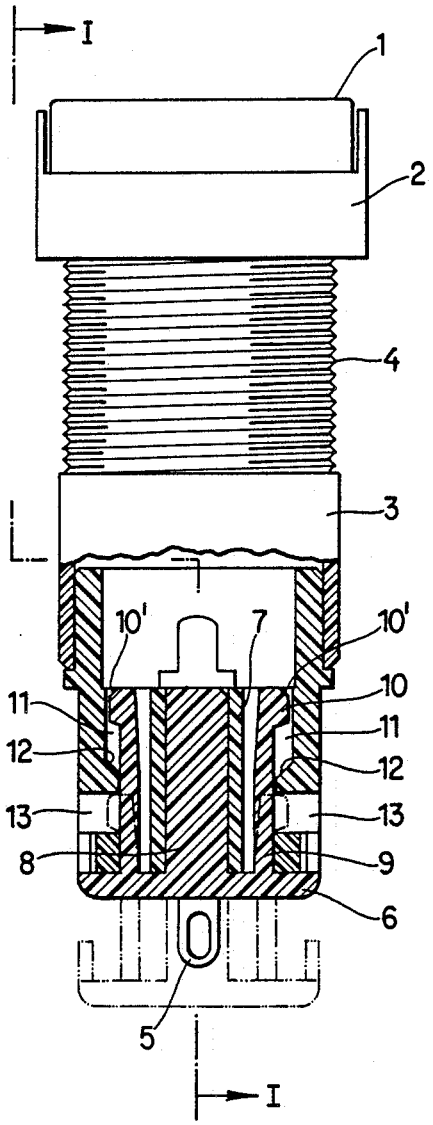
FIG. 2 is a partly elevational and partly sectional view substantially as seen in the direction of arrows from the line II—II of FIG. 1.

Referring first to FIGS. 1 and 2, there is shown an apparatus which can constitute a mechanical switch of the type disclosed, for example, in commonly owned U.S. Pat. No. 4,398,075 to Vogel and comprises a light-transmitting cap 1 in front of at least one radiation source (e.g., a light emitting diode, not shown) in a front frame 2 which is carried by the front portion of a tubular (preferably cylindrical) housing 3. The latter can be mounted on a supporting wall or panel, e.g., in a control panel, not shown. To this end, the housing 3 has an external thread 4 which can extend through a hole or bore in the supporting structure, and the housing is held in a selected axial position by a nut which mates with the external thread so that the rear portion of the housing is located behind and the cap 1 is located in front of the supporting structure.

The housing 3 is provided with two elongated terminals 5 in the form of parallel prongs which extend beyond the rear portion and are parallel with the axis of the housing. The exposed portions of the terminals 5 are attached to electrical conductors, not shown, in circuit with an energy source for the radiation source or sources in the frame 2. The conductors can be soldered to or are maintained in mere frictional engagement with the respective terminals 5.

In order to shield the terminals 5 upon connection to the respective conductors and to prevent accidental contact with bare ends of the conductors and/or directly with the terminals, the improved apparatus further comprises a guard or shroud 6 which is reciprocably mounted on the housing 3 for movement along a straight path extending in parallelism with the terminals 5 between a first position (shown in FIGS. 1 and 2 by solid lines) in which the terminals 5 are exposed and hence accessible for attachment of conductors, and a second position (shown in FIGS. 1 and 2 by phantom lines) in which the terminals 5 are concealed within the shroud. The arrangement is preferably such that the shroud 6 is inseparably connected with the housing 3 for movement between its first and second positions.

The bottom wall of the shroud 6 has windows 6' for the terminals 5, and the shroud further includes a substantially centrally located follower 8 which is guided in a complementary passage defined by a portion 7 of the housing 3 so that the shroud 6 is confined to reciprocatory movement along the aforementioned straight path which is parallel to the terminals 5 and to the axis of the housing 3.

The means for inseparably securing the shroud 6 to the housing 3 includes two elastic detent elements in the form of prongs 9 with pallets 10 which limit the extent of movability of the shroud with reference to the housing in at least one direction, particularly in a direction to separate the shroud from the housing, namely downwardly and beyond the phantom-line position of FIGS. 1 and 2. The detent elements 9 are elastic prongs which are guided in complementary channels 11 of the housing 3, and each channel 11 communicates with a radially extending hole or socket 13 which is provided in the housing 3 to receive the respective pallet 10 in the second (extended) position of the shroud 6. The sockets 13 are outwardly adjacent to ramps or cams 12 which bound portions of the respective channels 11 and must be engaged by the corresponding pallets 10 during movement of the shroud 6 from the first to the second position in which the pallets 10 snap into the respective sockets 13 to thus prevent separation of the shroud from the housing 3 as well as to releasably hold the shroud in the second position.

The shroud 6 assumes the solid-line position of FIGS. 1 and 2 during and/or upon completion of mounting of the housing 3 in a supporting structure. Thus, the terminals 5 then extend through the windows 6' and beyond the bottom wall of the shroud so that they can be conveniently soldered or otherwise reliably affixed to the corresponding conductors. At such time, the inner end faces of the pallets 10 can abut an internal surface or shoulder of the housing 3 and the bottom wall of the shroud 6 can abut the rear end face of the housing to ensure that the shroud is maintained in a predetermined (first) position in which the terminals 5 are readily accessible.

When the attachment of conductors to the terminals 5 is completed, the shroud 6 is pulled downwardly, as seen in FIGS. 1 and 2, with the exertion of a relatively small force which suffices to move the pallets 10 in the respective channels 11 whereby the pallets 10 engage the respective cams or ramps 12 and cause the associated detent elements 9 to store energy which is dissipated, at least in part, when the pallets 10 move into positions of register with the respective sockets 13. The surfaces bounding these sockets can be said to constitute female detent elements which are complementary to the male detent elements (prongs 9 and pallets 10) and cooperate with the latter in releasably holding the shroud 6 in the second position. Once the pallets 10 have penetrated into the respective sockets 12, the shroud 6 is locked in the second position and cannot be separated from the housing 3 or returned to the first position except by resorting to a tool (which can enter the sockets 13 to expel the respective pallets 10 back into their channels 11) or by at least partially destroying the shroud.

If it is desired to install the shroud 6 in such a way that it can be moved back and forth between the first and second positions without resorting to tools and without damaging or destroying the housing 3 and/or the shroud, the upper end faces of the pallets 10 are bevelled (as at 10') so that they can cause the respective prongs 9 to store energy in response to a push against the bottom wall of the shroud 6 in a direction toward the housing 3. This results in expulsion of the pallets 10 from their respective sockets 13 whereupon the shroud 6 can be pushed to the solid-line position of FIGS. 1 and 2 or it can be completely separated from the housing 3 by pulling it in the opposite direction.

If the pallets 10 are modified in the just outlined manner (by the provision of bevels 10'), it is desirable to select the slope of the bevels 10' in such a way that the force which, is required to expel the pallets 10 from their sockets 13 for the purpose of moving the shroud 6 back to the first position is a multiple of the force which is required to move the shroud 6 from the first to the second position. This can be readily achieved by appropriate selection of slopes of the ramps 12 and bevels 10'. Such selection of the ratio of forces which must be applied to move the shroud 6 from the first to the second position and from the second position back to the first position is desirable and advantageous because it reduces the likelihood of accidental shifting of the shroud back to the first position at a time when the shroud is supposed to shield the terminals 5 and the bare ends of conductors which are connected to the terminals.

The pallets 10 and the surfaces bounding the sockets 13 can be said to constitute a first detent unit which releasably holds the shroud 6 in the second position. The bottom wall of the shroud 6 and the adjacent rear end face of the housing 3 can be said to constitute a second detent unit which releasably holds the shroud in the first position. The forces which oppose movement of the shroud 6 from the first to the second position are those generated as a result of friction between the follower 8 and the adjacent portion 7 of the housing 3 as well as those generated as a result of friction between the prongs 9 and the surfaces bounding the respective channels 11. The first detent unit is designed to form-lockingly hold the shroud 6 in the second position, and the second detent unit is designed to force-lockingly hold the shroud in the first position.

Figure 3:
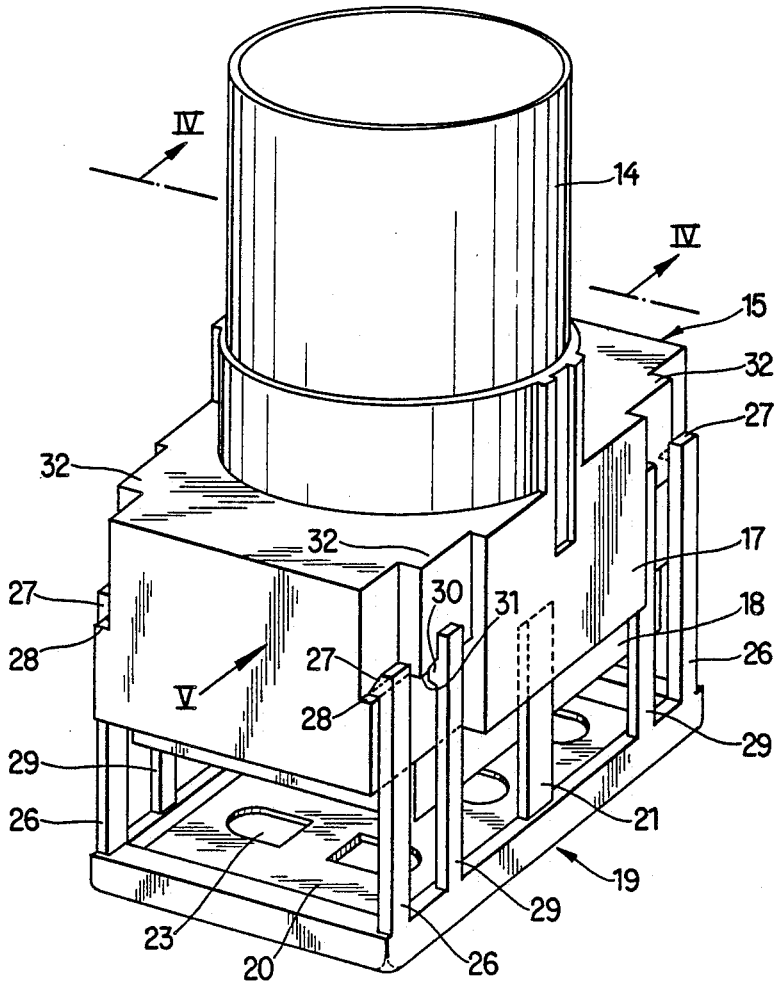
FIG. 3 is a fragmentary perspective view of a second apparatus wherein a casing for one or more signal generating components is separably secured to the housing.
Figure 4:
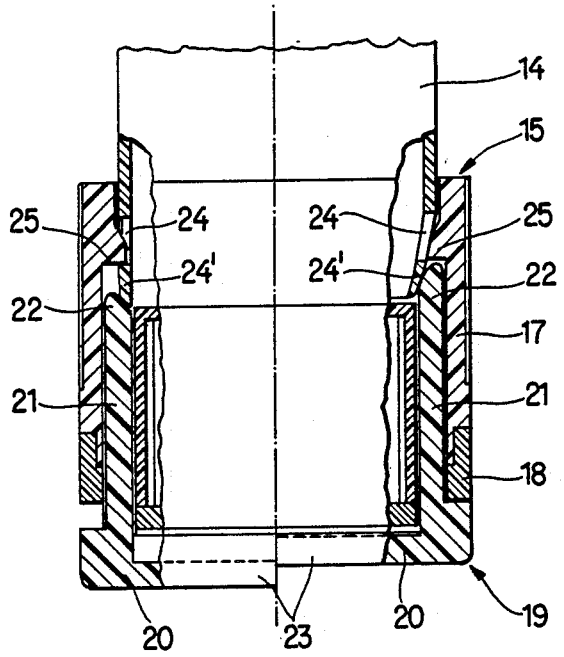
FIG. 4 is a fragmentary partly elevational and partly sectional view, substantially as seen in the direction of arrows from the line IV—IV of FIG. 3.
Figure 5:
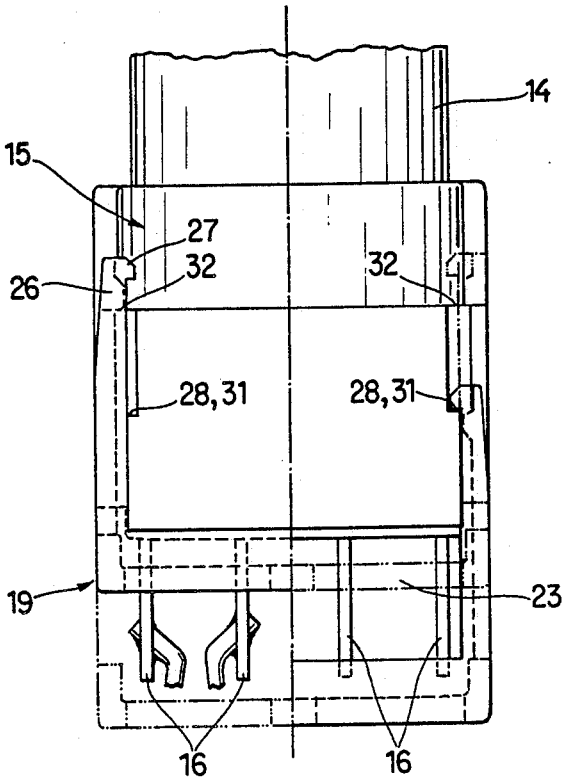
FIG. 5 is a view as seen in the direction of arrow V in FIG. 3.

FIGS. 3 to 5 illustrate a second embodiment of the improved apparatus. This apparatus includes a casing 14 for one or more switches, light sources and/or other parts (not shown) at the front end of a housing 15. The switch or switches in the casing 14 can be of the type disclosed in the aforementioned patent to Vogel or in the commonly owned U.S. Pat. No. 4,766,306 granted to Bichsel et al. Such switch or switches can include a pushbutton which is depressible to thereby engage or disengage electric contacts in the housing 15 in a manner not forming part of the present invention. The contact or contacts in the housing 15 are connected with terminals 16 (FIG. 5) which project rearwardly beyond the rear portion 18 of the housing 15 and are connected to conductors (two shown in FIG. 5) which are in circuit with an energy source.

The housing 15 includes a front or upper portion 17 and the aforementioned lower or rear portion 18. The two portions are rigidly connected to each other. On the other hand, the rear portion of the casing is separably secured to the front portion 17 of the housing 15 and can be disengaged from the front portion 17 in response to movement of a shroud or guard 19 to a third position which is shown in the right-hand portion of FIG. 4. In addition, the shroud 19 is movable to a first position (shown by solid lines in the left-hand parts of FIGS. 4 and 5) in which the terminals 16 are exposed and accessible (the terminals 16 are not shown in FIGS. 3 and 4), and a second position (shown by solid lines in FIG. 3 and the right-hand portion of FIG. 5) in which the terminals 16 are confined in the shroud.

The shroud 19 assumes the first position preparatory to attachment of conductors to the terminals 16 which are then readily accessible as shown in the left-hand portion of FIG. 5. The bottom wall 20 of the shroud 19 is then adjacent but still spaced apart from the rear portion 18 of the housing 15. Such bottom wall has one or more windows 23 for the terminals 16.

The means for separably securing the casing 14 to the front portion 17 of the housing 15 includes two male detent elements 25 in the front portion 17 of the housing 15 and two elastically deformable female detent elements 24' forming part of the casing 14. The female detent elements 24' have sockets or holes 24 for the respective male detent elements 25. The male detent elements 25 extend into the sockets 24 of the respective female detent elements 24' in the first and second positions of the shroud 19. The shroud 19 has two longitudinally extending disengaging members 21 which penetrate between the respective male and female detent elements 25, 24' to thus disengage the casing 14 from the housing portion 17 in response to movement of the shroud 19 from the first position which is shown in the left-hand part to the third position which is shown in the right-hand part of FIG. 4. The free end portions or tips 22 of the disengaging members 21 are designed to readily penetrate between the corresponding male and female detent elements 25, 24'. The wall of the housing 15 has suitable slots for the reciprocable disengaging members 21 of the shroud 19.

When the attachment of conductors to some or all of the terminals 16 is completed, the shroud 19 is moved from the first position to the second position which is shown in the right-hand part of FIG. 5 and in which the terminals 16 are confined in the interior of the shroud. The bottom wall 20 of the shroud 19 is then located at a maximum distance from the rear portion 18 of the housing 15.

The male detent elements 25 of the means for detachably securing the casing 14 to the housing 15 can be caused to penetrate into the respective sockets 24 as soon as the shroud 19 is caused to leave the third position in which its bottom wall 20 is immediately or closely adjacent to or actually abuts the rear portion 18 of the housing 15.

The detent means for releasably holding the shroud 19 in the second position simultaneously performs the function of inseparably coupling the shroud to the housing 15. Such detent means comprises four symmetrically distributed elongated elastic detent elements 26 which have pallets 27 in the form of claws engageable with complementary detent elements in the form of external shoulders 28 provided on the housing 15. FIG. 3 shows the pallets 27 of the detent elements 27 in engagement with the respective shoulders 28, i.e., the shroud 19 is maintained in the second position in which the bottom wall 20 is located at a maximum distance from the rear portion 18 of the housing 15 and the terminals 16 are confined in the shroud. At such time, the pallets or teeth 30 of four additional elastic male detent elements 29 on the shroud 19 abut the respective external shoulders 31 of the housing 15 to offer a predetermined resistance to return movement of the shroud from the second position of FIG. 3 to the first position which is shown in the left-hand portion of FIG. 4. The four detent elements 29 form two pairs which are mirror symmetrical to each other with reference to a central symmetry plane of the shroud 19. The inclination of cam faces on the pallets 30 of the detent elements 29 and the elasticity of the elements 29 determine the force which must be applied to the shroud 19 in order to move the shroud 19 from the second to the first position. The resistance which the shroud 19 offers to movement from the second position of FIG. 3 can be selected practically at will, as long as it suffices to prevent accidental shifting of the shroud 19 from the second position.

When the movement of the shroud 19 from the second position of FIG. 3 to the first position is completed, the pallets 30 of the elastic detent elements 29 engage external shoulders 32 of the housing 15 to thus yieldably oppose a movement of the shroud 19 back to the second position of FIG. 3. Again, the resistance which the detent elements 29 offer to movement of the shroud 19 from the first to the second position can be selected practically at will, as long as it suffices to prevent accidental shifting of the shroud from the first to the second position. Movements of the shroud 19 from the first to the third position are opposed by the elastic detent elements 24' of the means for releasably securing the casing 14 to the front portion 17 of the housing 18, i.e., it is necessary to apply a certain force which enables the disengaging members 21 of the shroud 19 to move the female detent elements 24' inwardly and away from the adjacent male detent elements 25 of the housing 15.

It will be noted that the detent unit which includes the male detent elements 26 and their pallets 27, as well as the detent elements or shoulders 28 serves to releasably hold the shroud 19 in the second position of FIG. 3 and to inseparably couple the shroud to the housing 15. On the other hand, the unit including the detent elements 29, 30 and 31, 32 determines the magnitude of the force which is required to move the shroud from the first to the second position and from the second position back to the first position. The inclination of cam faces which are provided on the pallets 30 and respectively cooperate with the shoulders 31 and 32 of the housing 15 can be selected with a view to ensure that the shroud 19 will offer a desired resistance to movement to and from the first position. The force with which the detent elements 29 engage the shoulders 32 and the elasticity of detent elements 24' will determine the resistance which the shroud 19 offers to movement to the third position in which the casing 14 is separated from the housing 15.

Figure 6:
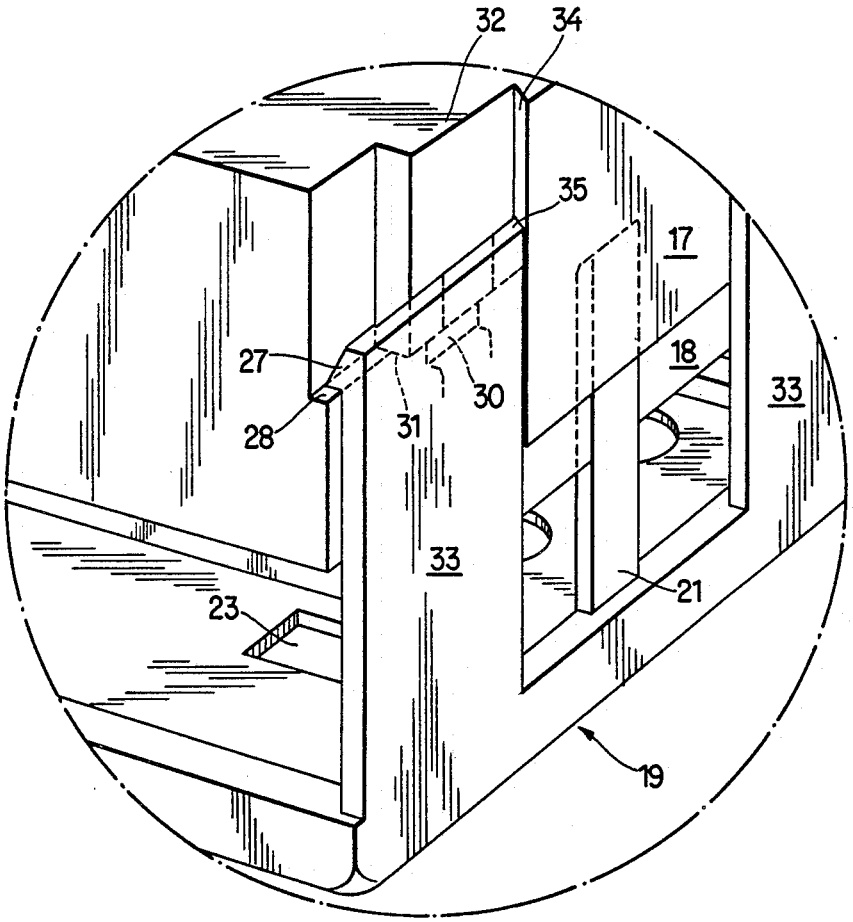
FIG. 6 is a fragmentary perspective view of a portion of a third apparatus constituting a modification of the apparatus which is shown in FIGS. 3 to 5.

FIG. 6 shows a portion of an apparatus which constitutes a modification of the apparatus of FIGS. 3 to 5. Each male detent element 26 of FIG. 3 is combined with a male detent element 29 into a single male detent element 33 (only two elements 33 can be seen in FIG. 6) which has a pallet 27 adapted to cooperate with a shoulder 28 of the housing as well as a pallet 30 adapted to cooperate with a shoulder 31 or 32 of the housing. An advantage of the apparatus which embodies the structure of FIG. 6 is that it renders it possible to increase the force with which the shroud 19 is held in the first and second positions. Such force can be increased still further by undercutting the housing, as at 34, and by properly configurating the adjacent portion 35 of each male detent element 33 so that it extends into the undercut portion 34. Therefore, when the operator wishes to move the shroud 19 from the first to the second position or vice versa, it is necessary to move the pallets 27 and 30 over the respective shoulders 28 and 31 or 32 (i.e., to bend or flex the elements 33 outwardly) and it is further necessary to bend the elements 33 sideways.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A current consuming apparatus, particularly a signal generating and transmitting apparatus, comprising a housing including a front portion and a rear portion; a plurality of electric terminals carried by said housing and extending beyond said rear portion; an electrically insulating shroud mounted on and reciprocable relative to said housing along a substantially straight path between a first position in which said terminals are exposed and accessible, particularly for connection to or for disconnection from electrical conductor means, and a second position in which said terminals are at least partially confined in said shroud, said shroud having window means through which said terminals extend in the first position of said shroud; and detent means for releasably holding said shroud at least in said second position, said shroud being free to remain in either of said first and second positions upon completion of movement to said first and second position.

2. The apparatus of claim 1, wherein said terminals are elongated and substantially parallel to each other, said path being substantially parallel to said terminals.

3. The apparatus of claim 1, wherein said detent means includes complementary first and second detent elements arranged to form-lockingly hold said shroud in said second position, said first element being provided in said housing and said second element being provided in said shroud.

4. The apparatus of claim 1, wherein said detent means comprises complementary first and second detent elements arranged to force-lockingly hold said shroud in said second position, said first element being provided in said housing and said second element being provided in said shroud.

5. The apparatus of claim 1, wherein said detent means comprises a first unit having means for releasably holding said shroud in said first position and a second unit having means for releasably holding said shroud in said second position.

6. The apparatus of claim 5, wherein at least one of said units includes means for force-lockingly holding said shroud in the respective position.

7. The apparatus of claim 5, wherein at least one of said units comprises means for form-lockingly holding said shroud in the respective position.

8. A current consuming apparatus, particularly a signal generating and transmitting apparatus, comprising a housing including a front portion and a rear portion; a plurality of electric terminals carried by said housing and extending beyond said rear portion; an electrically insulating shroud mounted on and reciprocable relative to said housing along a substantially straight path between a first position in which said terminals are exposed and accessible, particularly for connection to or for disconnection from electrical conductor means, and a second position in which said terminals are at least partially confined in said shroud, said shroud having window means through which said terminals extend in the first position of said shroud; and detent means for releasably holding said shroud in at least one of said positions, said detent means including means for inseparably coupling said shroud to said housing.

9. A current consuming apparatus, particularly a signal generating and transmitting apparatus, comprising a housing including a front portion and a rear portion; a plurality of electric terminals carried by said housing and extending beyond said rear portion; an electrically insulating shroud mounted on and reciprocable relative to said housing along a substantially straight path between a first position in which said terminals are exposed and accessible, particularly for connection to or for disconnection from electrical conductor means, and a second position in which said terminals are at least partially confined in said shroud, said shroud having window means through which said terminals extend in the first position of said shroud; a casing; and disengageable means for separably securing said casing to said housing, said shroud being further movable with reference to said housing to and from a third position and having means for disengaging said disengageable means in said third position thereof.

10. The apparatus of claim 9, wherein said disengageable means comprises a first detent element in said casing and a second detent element provided in said housing and normally engaging said first detent element to thereby secure said casing to said housing, said disengaging means including means for separating said detent elements from each other in response to movement of said shroud to said third position.

11. The apparatus of claim 9, wherein said terminals extend outwardly beyond said window means in the third position of said shroud.

12. The apparatus of claim 9, further comprising detent means for releasably holding said shroud in at least one of said first and second positions.

13. The apparatus of claim 12, wherein said detent means includes a first unit having means for releasably holding said shroud in said first position and a second unit having means for releasably holding said shroud in said second position.

14. The apparatus of claim 13 wherein each of said units comprises a first detent element on said housing and a complementary second detent element on said shroud, said second element of said second unit being integral with said second element of said first unit.

15. A current consuming apparatus, particularly a signal generating and transmitting apparatus, comprising a housing including a front portion and a rear portion; a plurality of electric terminals carried by said housing and extending beyond said rear portion; an electrically insulating shroud mounted on and reciprocable relative to said housing along a substantially straight path between a first position in which said terminals are exposed and accessible, particularly for connection to or for disconnection from electrical conductor means, and a second position in which said terminals are at least partially confined in said shroud, said shroud having window means through which said terminals extend in the first position of said shroud; and at least one signal lamp supported by said housing.

* * * * *